US008770778B2

(12) United States Patent
Pereira et al.

(10) Patent No.: US 8,770,778 B2
(45) Date of Patent: Jul. 8, 2014

(54) UTILITY LIGHT KIT FOR ATTACHMENT TO THE TOP OF A LADDER

(71) Applicants: Herberth A. Pereira, Selden, NY (US); Stephen John Gerli, Selden, NY (US); Stephen Joseph Gerli, Holbrook, NY (US); James A. McCrea, East Patchogue, NY (US)

(72) Inventors: Herberth A. Pereira, Selden, NY (US); Stephen John Gerli, Selden, NY (US); Stephen Joseph Gerli, Holbrook, NY (US); James A. McCrea, East Patchogue, NY (US)

( * ) Notice: Subject to any disclaimer, the term of this patent is extended or adjusted under 35 U.S.C. 154(b) by 0 days.

(21) Appl. No.: 13/659,840

(22) Filed: Oct. 24, 2012

(65) Prior Publication Data

US 2013/0128557 A1 May 23, 2013

Related U.S. Application Data

(60) Provisional application No. 61/563,335, filed on Nov. 23, 2011.

(51) Int. Cl.

| | |
|---|---|
| ***F21S 8/00*** | (2006.01) |
| ***F21V 33/00*** | (2006.01) |
| ***A47B 23/06*** | (2006.01) |

(52) U.S. Cl.
USPC ..... 362/145; 362/127; 362/157; 362/131

(58) Field of Classification Search
None
See application file for complete search history.

(56) References Cited

U.S. PATENT DOCUMENTS

| | | | | |
|---|---|---|---|---|
| 4,976,450 | A * | 12/1990 | Ellefson | 280/79.11 |
| 6,017,085 | A * | 1/2000 | LaCroix et al. | 297/173 |
| 6,443,260 | B1 * | 9/2002 | Katz et al. | 182/129 |

* cited by examiner

*Primary Examiner* — Natalie Walford

(57) ABSTRACT

A utility light kit has one or more lights that can mount on a top platform of a ladder without requiring the user to use one hand for holding a light. The utility light kit is a portable, cordless, safe, battery-operated device that includes a tool utility tray for keeping tools or other objects conveniently located when working on a job where the ladder needs to be moved frequently. The light can be an LED panel having a plurality of lights that can be rotated to provide light in a desired area. When the utility light kit is closed, the utility tray is covered, preventing the contents from spilling out while moving the ladder. An attachment mechanism, such as clips or an attachment strap, can secure the utility light kit to the top platform of the ladder.

12 Claims, 2 Drawing Sheets

UTILITY LIGHT KIT FOR ATTACHMENT TO THE TOP OF A LADDER

CROSS-REFERENCE TO RELATED APPLICATION

This application claims the benefit of priority of U.S. provisional application No. 61/563,335, filed Nov. 23, 2011, the contents of which are herein incorporated by reference.

BACKGROUND OF THE INVENTION

The present invention relates to ladder accessories and, more particularly, to a utility light kit that can attach to the top of a ladder to store items and provide lighting.

Conventional lights often need to be held by one hand, only giving the user one hand for moving on the ladder or performing work from the ladder. A user could strap a light onto the ladder, but such lights may be difficult to aim in the desired direction and may be limited by the particular mounting system.

Other devices may require the lights to be plugged in and, therefore, are not fully portable. These devices may require an extension cord to attach to the light and extend from the ladder, which could lessen the safety for the user on the ladder. Moreover, these devices may require the user to unplug, find another outlet, and plug the power back in when moving the ladder to different locations during use. Finally, many step ladders include a small recess for keeping objects on the top platform of the ladder. Some conventional lights may make these recessed areas less usable, requiring the user to find an alternate way to store items during use of the ladder.

As can be seen, there is a need for an improved utility light kit for use on the top platform of a ladder.

SUMMARY OF THE INVENTION

In one aspect of the present invention, a utility light kit comprises a base plate; a utility tray; a hinge bar bracket attaching opposite sides of the base plate with opposite sides of the utility tray, wherein the utility tray can move from a first position, directly over the base plate to a second position offset from the base plate; and a light panel attached to pivot from the utility tray about a hinge.

In another aspect of the present invention, a utility light kit comprises a base plate; a utility tray; a hinge bar bracket attaching opposite sides of the base plate with opposite sides of the utility tray, wherein the utility tray can move from a first position, directly over the base plate to a second position offset from the base plate; a light panel attached to pivot from the utility tray about a hinge; a plurality of light emitting diodes disposed to emit light from the light panel; a tension knob to provide tension to the hinge to keep the light panel at a desired pivot point relative to the utility tray; and an attachment mechanism for securing the base plate to a top platform of a ladder.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a utility light kit having one or more lights that can mount on a top platform of a ladder without requiring the user to use one hand for holding a light. The utility light kit is a portable, cordless, safe, battery-operated device that includes a tool utility tray for keeping tools or other objects conveniently located when working on a job where the ladder needs to be moved frequently. The light can be an LED panel having a plurality of lights that can be rotated to provide light in a desired area. When the utility light kit is closed, the utility tray is covered, preventing the contents from spilling out while moving the ladder. An attachment mechanism, such as clips or an attachment strap, can secure the utility light kit to the top platform of the ladder.

Figure 1:
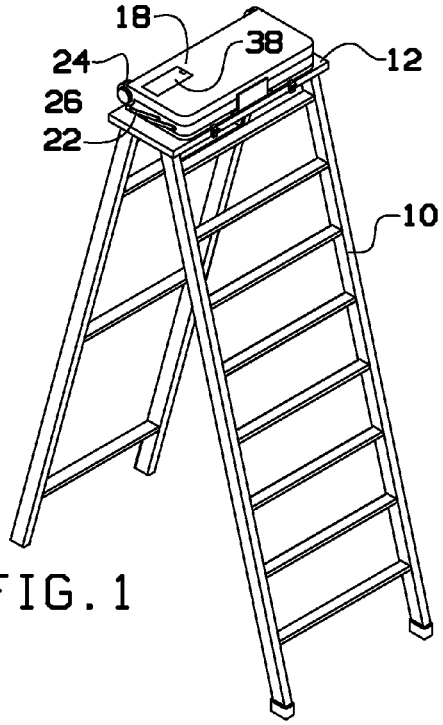
FIG. 1 is a perspective view of a ladder having a utility light kit attached thereto according to an exemplary embodiment of the present invention.
Figure 2:
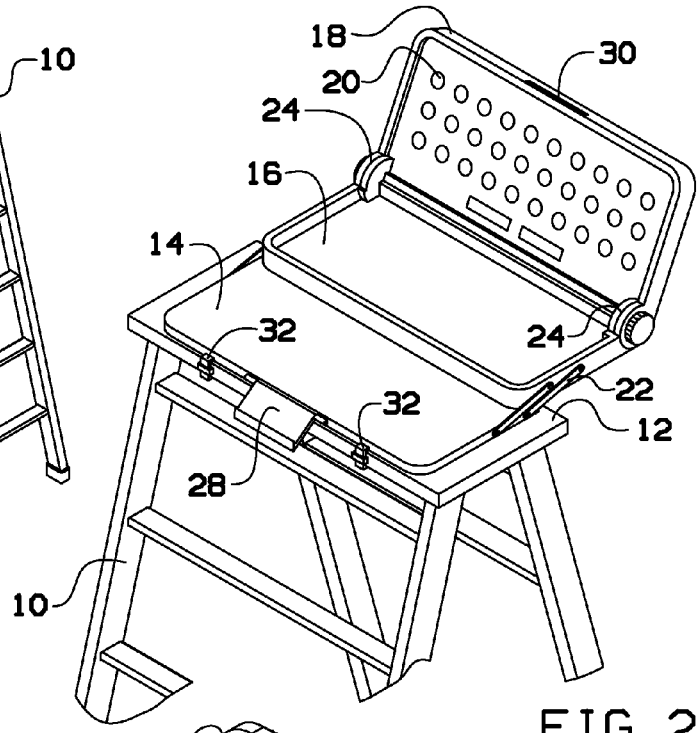
FIG. 2 is a detailed perspective view of the utility light kit of FIG. 1, disposed on top of the ladder, in an opened configuration.
Figure 3:
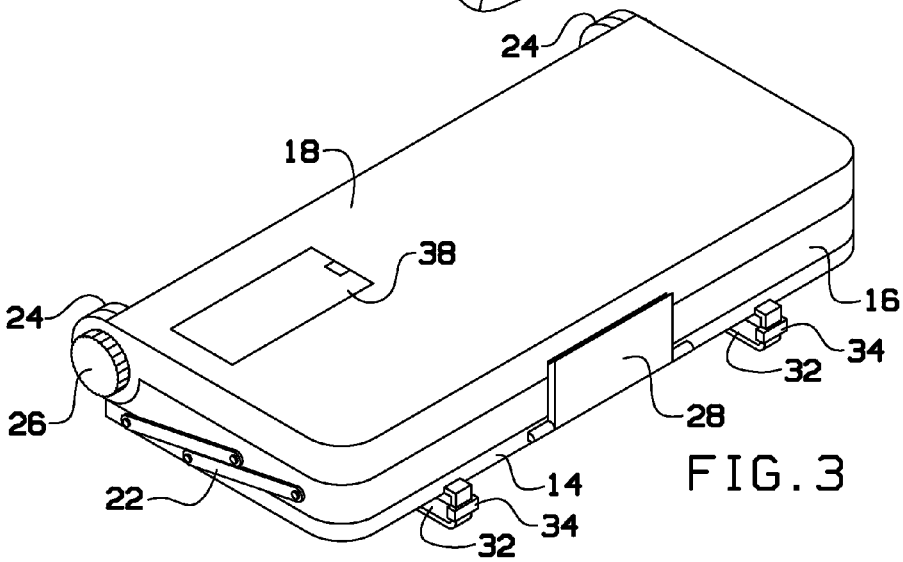
FIG. 3 is a perspective view of the utility light kit of FIG. 1 in a closed configuration.
Figure 4:
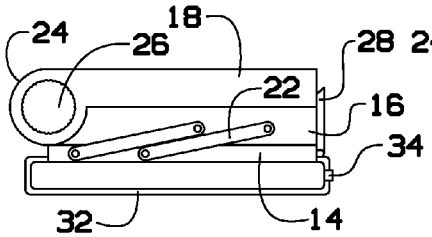
FIG. 4 is a side view of the utility light kit of FIG. 1 in the closed configuration.
Figure 5:
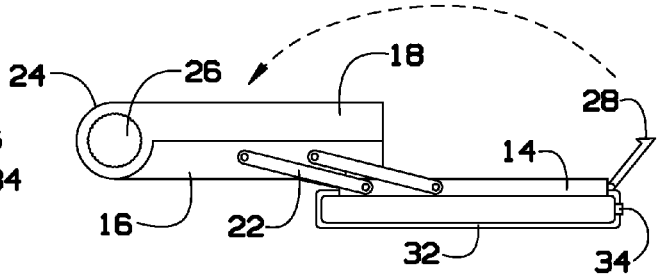
FIG. 5 is a side view of the utility light kit of FIG. 1 in a partially opened configuration.
Figure 6:
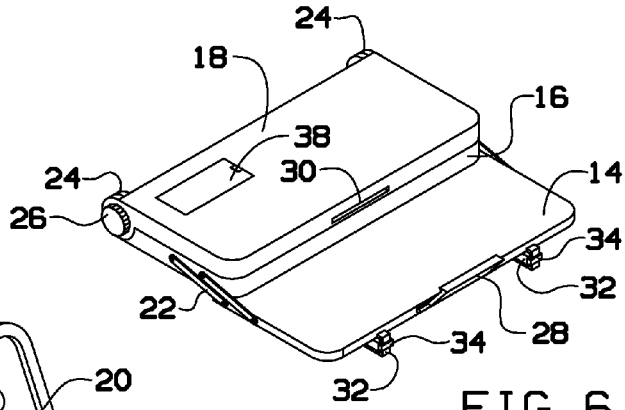
FIG. 6 is a perspective view of the utility light kit of FIG. 1 in a partially opened configuration.
Figure 7:
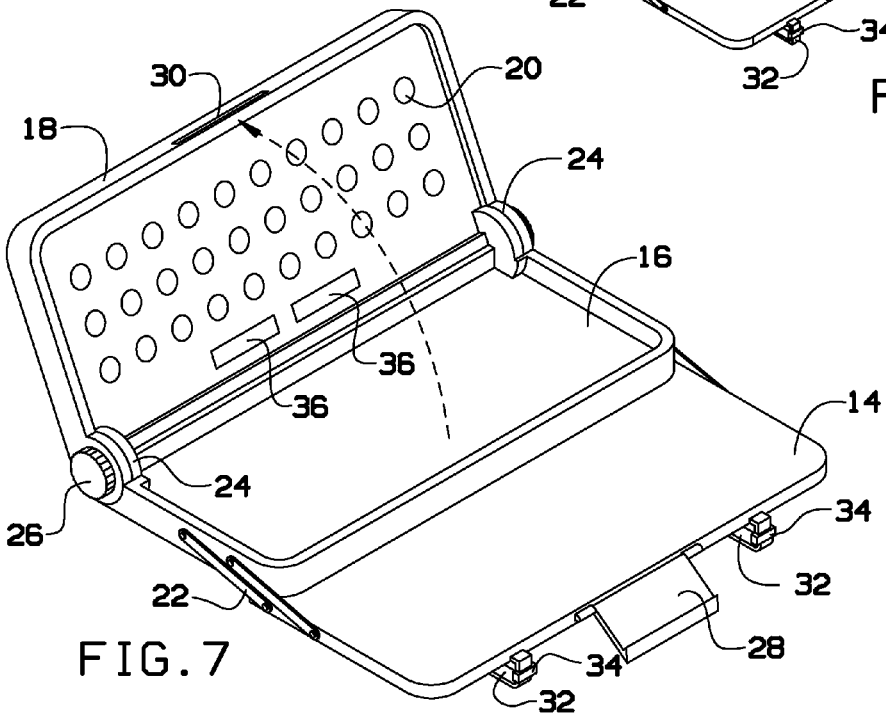
FIG. 7 is a perspective view of the utility light kit of FIG. 1 in a fully opened position.

Referring now to FIGS. 1 through 7, a utility light kit can be mounted to a top platform 12 of a ladder 10. The utility light kit can include a kit base plate 14 having constraining hinge bar brackets 22 extending from each side thereof. The hinge bar brackets 22 can attach to a utility tray 16, allowing the utility tray 16 to pivot between a first position directly over the base plate 14 (see FIGS. 1, 3 and 4) and a second position offset from the base plate 14 (see FIGS. 2 and 5-7).

An attachment mechanism can be adapted to hold the base plate 14 onto the top platform 12 of the ladder 10. The attachment mechanism can be made in various designs. For example, a strap 32 can extend from one side of the base 14, under the top plate 12 of the ladder 10, and attach to a second, opposite side of the base 14 with a strap adjustment mechanism 34.

A latch 28 can pivot into a latch mate 30 to keep the utility light kit in a closed configuration. A user can move the latch 28 out of the latch mate 30 to permit opening of the utility light kit.

A light panel 18 can attach to the utility tray 16 in such a manner to allow the light panel 18 to pivot about 270 degrees about a hinge 24. A tension knob 26 can be tightened to retain the light panel 18 in a desired position. One or more lights 20 can be disposed to emit light from the light panel 18. Typically, a plurality of light emitting diodes (LEDs) can be used for the lights 20.

A battery compartment 38 can contain one or more batteries to power the lights 20. The batteries can be, for example, rechargeable batteries and a charging receptacle (not shown) can be provided in the utility light kit.

One or more switches 36 can be disposed on the utility light kit for powering the lights 20. For example, two switches 36 can be used to power the lights 20. In some embodiments, the lights 20 can be powered at high and low power, where the switches 36 can provide selection between such power settings.

It should be understood, of course, that the foregoing relates to exemplary embodiments of the invention and that modifications may be made without departing from the spirit and scope of the invention as set forth in the following claims.

What is claimed is:

1. A utility light kit comprising:

a base plate;

a utility tray;

a hinge bar bracket attaching opposite sides of the base plate with opposite sides of the utility tray, wherein the utility tray can move from a first position, directly over the base plate to a second position offset from the base plate;

a light panel attached to pivot from the utility tray about a hinge; and an attachment mechanism for securing the base plate to a top platform of a ladder.

2. The utility light kit of claim 1, further comprising a tension knob to provide tension to the hinge to keep the light panel at a desired pivot point relative to the utility tray.

3. The utility light kit of claim 1, wherein the attachment mechanism includes at least one strap extending from one side of the base plate and at least one strap attachment mechanism for tightening the at least one strap.

4. The utility light kit of claim 1, wherein the light panel includes a plurality of light emitting diodes.

5. The utility light kit of claim 1, further comprising a latch operable to fit into and be removed from a latch mate, the latch securing the utility light kit in a closed position.

6. The utility light kit of claim 1, further comprising a battery compartment operable to hold one or more batteries to power lights on the light panel.

7. The utility light kit of claim 1, further comprising one or more light switches to regulate power supplied to the light panel.

8. A utility light kit comprising:

a base plate;

a utility tray;

a hinge bar bracket attaching opposite sides of the base plate with opposite sides of the utility tray, wherein the utility tray can move from a first position, directly over the base plate to a second position offset from the base plate;

a light panel attached to pivot from the utility tray about a hinge;

a plurality of light emitting diodes disposed to emit light from the light panel;

a tension knob to provide tension to the hinge to keep the light panel at a desired pivot point relative to the utility tray; and an attachment mechanism for securing the base plate to a top platform of a ladder.

9. The utility light kit of claim 8, wherein the attachment mechanism includes at least one strap extending from one side of the base plate and at least one strap attachment mechanism for tightening the at least one strap.

10. The utility light kit of claim 8, further comprising a latch operable to fit into and be removed from a latch mate, the latch securing the utility light kit in a closed position.

11. The utility light kit of claim 8, further comprising a battery compartment operable to hold one or more batteries to power the lights.

12. The utility light kit of claim 8, further comprising one or more light switches to regulate power supplied to the light panel.

* * * * *